US009075387B2

(12) United States Patent
Tanabe et al.

(10) Patent No.: US 9,075,387 B2
(45) Date of Patent: Jul. 7, 2015

(54) CARTRIDGE AND IMAGE FORMING APPARATUS

(71) Applicant: CANON KABUSHIKI KAISHA, Tokyo (JP)

(72) Inventors: Masato Tanabe, Susono (JP); Hideki Maeshima, Mishima (JP); Hideki Kakuta, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/035,792

(22) Filed: Sep. 24, 2013

(65) Prior Publication Data

US 2014/0086597 A1 Mar. 27, 2014

(30) Foreign Application Priority Data

Sep. 27, 2012 (JP) ..... 2012-214482

(51) Int. Cl.
*G03G 21/18* (2006.01)

(52) U.S. Cl.
CPC ..... *G03G 21/18* (2013.01); *G03G 21/1867* (2013.01); *G03G 21/1878* (2013.01)

(58) Field of Classification Search
CPC ..... G03G 21/1878
USPC ..... 399/12, 90, 111
See application file for complete search history.

(56) References Cited

U.S. PATENT DOCUMENTS

| | | | | |
|---|---|---|---|---|
| 7,203,442 | B2 * | 4/2007 | Matsubara et al. | 399/90 |
| 7,382,988 | B2 * | 6/2008 | Nakazato | 399/12 |
| 7,433,622 | B2 * | 10/2008 | Chadani et al. | 399/90 |
| 7,450,877 | B2 * | 11/2008 | Miyabe et al. | 399/90 |
| 7,689,144 | B2 * | 3/2010 | Martin et al. | 399/111 X |
| 7,794,260 | B2 * | 9/2010 | Chen et al. | 439/329 |
| 8,073,355 | B2 * | 12/2011 | Lee et al. | 399/90 |

FOREIGN PATENT DOCUMENTS

JP 2011-39541 A 2/2011

* cited by examiner

*Primary Examiner* — Sandra Brase
(74) *Attorney, Agent, or Firm* — Canon USA Inc. IP Division

(57) ABSTRACT

A cartridge includes: a memory portion; a substrate having the memory portion and an electrical contact; a support portion for supporting the substrate with the electrical contact being exposed; a first movement regulation portion configured to regulate the movement of the substrate ; and a second movement regulation portion configured to regulate the movement of the substrate, wherein the movement regulation direction in which the movement of the substrate is regulated by the second movement regulation portion is the same as the movement regulation direction in which the movement of the substrate is regulated by the first movement regulation portion, and wherein the movement regulation distance that the movement of the substrate is regulated by the second movement regulation portion is shorter than or equal to the movement regulation distance that the movement of the substrate is regulated by the first movement regulation portion.

18 Claims, 15 Drawing Sheets

CARTRIDGE AND IMAGE FORMING APPARATUS

BACKGROUND OF THE INVENTION

1. Field of the Invention

The present invention relates to a cartridge and an image forming apparatus employing the same. In particular, the present invention relates to a cartridge used for forming an image on a recording material (recording medium) by employing the electrophotographic image forming process, and to an electrophotographic image forming apparatus using the same. Examples of the electrophotographic image forming apparatus include a printer (a laser beam printer, an LED printer or the like), a copying machine, a facsimile apparatus, a word processor, and a multifunction peripheral combining these (i.e., a multifunction printer).

2. Description of the Related Art

Conventionally, in an electrophotographic image forming apparatus employing the electrophotographic image forming process, an electrophotographic photosensitive drum and a process unit acting on the electrophotographic photosensitive drum are integrated into a cartridge. And, in a process cartridge system, this cartridge is detachably attached to the apparatus main body of the electrophotographic image forming apparatus.

According to this process cartridge system, it is possible for the user himself to perform maintenance on the electrophotographic image forming apparatus without relying on a serviceman, whereby it is possible to achieve a substantial improvement of operability, so that the process cartridge system is widely employed in electrophotographic image forming apparatuses.

Nowadays, in some process cartridges, there is mounted a memory (integrated circuit (IC) memory or the like) for storing information to be transmitted to the image forming apparatus main body of an electrophotographic image forming apparatus. And, when such a process cartridge is attached to an image forming apparatus main body, information exchange is possible between the image forming apparatus main body and the process cartridge. As a result, the process cartridge use condition or the like is reported to a control unit of the image forming apparatus main body.

Regarding the method of fixing the memory to the process cartridge, various method are known. According to one of such known methods, a protrusion portion of a frame member is fusion-bonded after the attachment of the memory to the frame member of the process cartridge to prevent detachment of the memory (Japanese Patent Application Laid-Open No. 2011-39541).

However, in the construction discussed in Japanese Patent Application Laid-Open No. 2011-39541, to prevent detachment of the memory due to a change in attitude or movement of the frame member of the process cartridge at the time of assembly thereof, it is necessary to fusion-bond the protrusion of the frame member immediately after the attachment of the memory to the frame member.

To re-utilize a frame member which has not passed an inspection process at the time of assembly, it is necessary to detach the memory therefrom, so that it is necessary to attach the memory immediately before the final inspection process, and to fusion-bond the protrusion after the completion of the final inspection process.

In the above-described construction, there are restrictions in the memory assembling order to make the frame member re-usable. Further, it is necessary to arrange the memory at a position which allows the memory to be mounted in an eventual cartridge state.

SUMMARY OF THE INVENTION

The present invention is directed to a cartridge capable of improving degree of freedom also regarding the memory arrangement by improving degree of freedom in memory assembling order, and directed to an image forming apparatus using the same.

According to an aspect of the present invention, a cartridge includes: a memory portion configured to store information regarding the cartridge; a substrate having the memory portion and an electrical contact; a support portion for supporting the substrate with the electrical contact being exposed; a first movement regulation portion being flexible and configured to regulate the movement of the substrate by means of the support portion; and a second movement regulation portion configured to regulate the movement of the substrate, wherein the movement regulation direction in which the movement of the substrate is regulated by the second movement regulation portion is the same as the movement regulation direction in which the movement of the substrate is regulated by the first movement regulation portion, and wherein the movement regulation distance that the movement of the substrate is regulated by the second movement regulation portion, is shorter than or equal to the movement regulation distance that the movement of the substrate is regulated by the first movement regulation portion.

The present invention further provides an apparatus employing a cartridge, and a cartridge manufacturing method. Further, the present invention provides a process cartridge and an image forming apparatus using the same.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

In the following, a cartridge, an electrophotographic image forming apparatus, etc. according to the present invention will be described with reference to the drawings.

The cartridge according to the present invention is characterized by a portion supporting a memory, so that it is applicable not only to a process cartridge for electrophotography but also various cartridges. Further, the apparatus employing this cartridge is not restricted to an electrophotographic image forming apparatus but is also applicable to other apparatuses. Here, the process cartridge is the one having at least one of a developing unit, an exposure unit, and a charging unit as a processing unit acting on an electrophotographic photosensitive member.

[Overall Schematic Construction of the Image Forming Apparatus]

(Overall Construction of the Image Forming Apparatus)

Figure 1A:
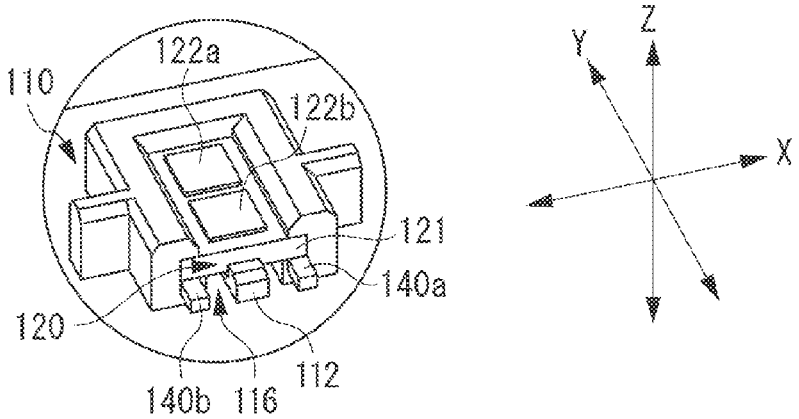
FIGS. 1A through 1D are explanatory views illustrating the construction of a cartridge contact support according to an exemplary embodiment of the present invention.
Figure 1B:
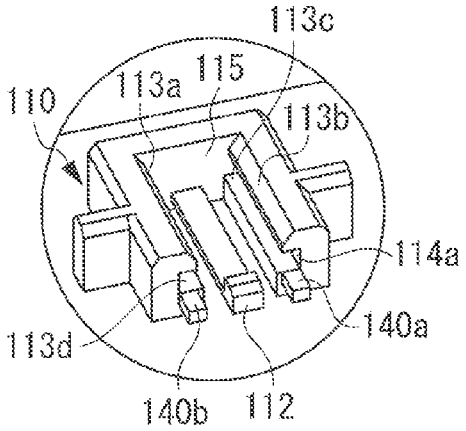
Figure 1C:
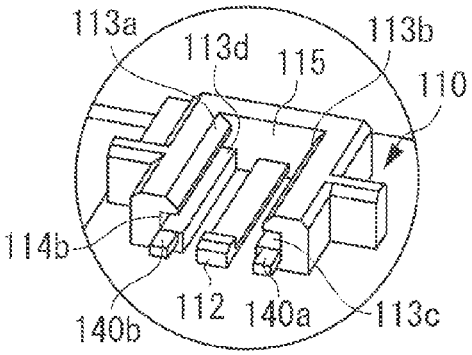
Figure 1D:
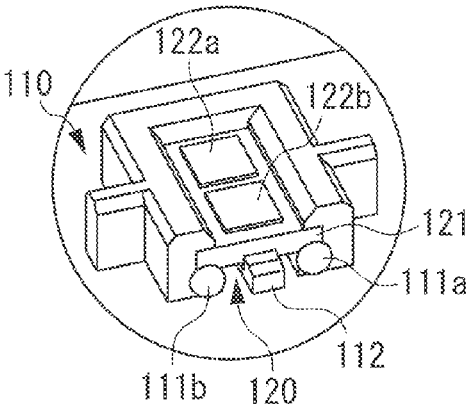
Figure 2:
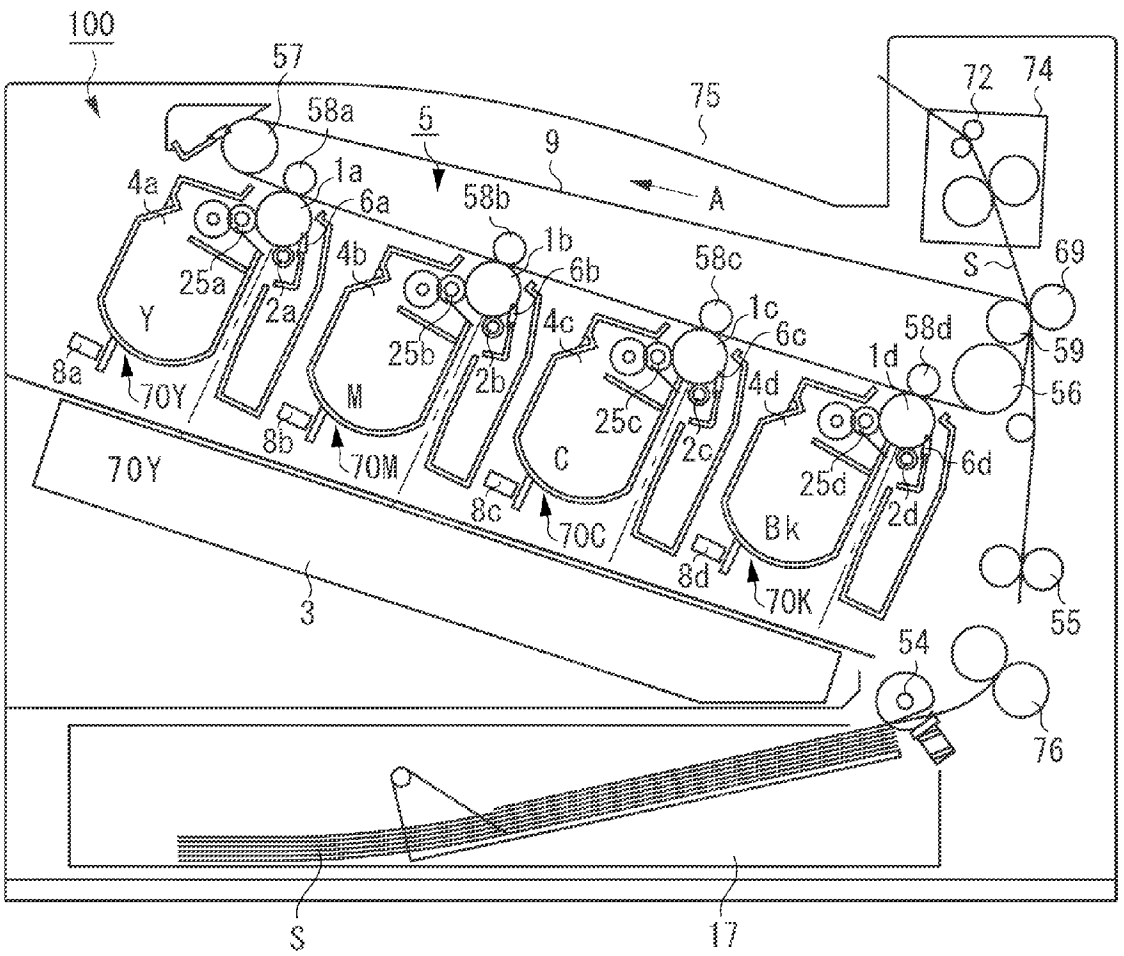
FIG. 2 is a main portion sectional view of an image forming apparatus according to an exemplary embodiment of the present invention.

First, the overall construction of an electrophotographic image forming apparatus (hereinafter referred to as the image forming apparatus) 100 will be described with reference to FIG. 2. As illustrated in FIG. 2, four detachable process cartridges 70 (70Y, 70M, 70C, and 70K) are attached by means of attachment members (not illustrated). The upstream side in the image forming apparatus 100 in an attachment direction of the process cartridge 70 will be defined as a front surface side, and the downstream side thereof will be defined as a depth surface side. In FIG. 2, the process cartridges 70 are arranged side by side within the main body of the apparatus 100 so as to be inclined with respect to the horizontal direction.

Each process cartridge 70 has an electrophotographic photosensitive drum (hereinafter referred to as the photosensitive drum) 1 (1*a*, 1*b*, 1*c*, 1*d*), and process units integrally arranged around the photosensitive drum 1, such as a charging roller 2 (2*a*, 2*b*, 2*c*, 2*d*), a developing roller 25 (25*a*, 25*b*, 25*c*, 25*d*), and a cleaning member 6 (6*a*, 6*b*, 6*c*, 6*d*). The charging roller 2 uniformly charges the surface of the photosensitive drum 1, and the developing roller 25 visualizes a latent image formed on the photosensitive drum 1 by developing with toner. And, the cleaning member 6 removes residual toner from the photosensitive drum 1 after the toner image formed on the photosensitive drum 1 has been transferred to a recording medium.

Further, below the process cartridges 70, there is provided a scanner unit 3 configured to perform selective exposure on the photosensitive drum 1 based on image information to form a latent image on each photosensitive drum 1.

A cassette 17 accommodating recording mediums S is attached to the lower portion of the apparatus main body 100. And, there is provided a recording medium conveyance unit so that a recording medium S may pass a secondary transfer roller 69 and a fixing unit 74 to be conveyed to a portion above the apparatus main body 100. That is, there are provided a feeding roller 54 for separately feeding the recording mediums in the cassette 17 one by one, a conveyance roller pair 76 for conveying the fed recording medium S, and a registration roller pair 55 for synchronization of the latent images formed on the photosensitive drums 1 with the recording medium S. Further, an intermediate transfer unit 5 is provided above the process cartridges 70 (70Y, 70M, 70C, and 70K) as an intermediate transfer unit for transferring the toner images formed on the photosensitive drums 1 (1*a*, 1*b*, 1*c*, and 1*d*). The intermediate transfer unit 5 has a driving roller 56, a driven roller 57, primary transfer rollers 58 (58*a*, 58*b*, 58*c*, and 58*d*) situated at positions opposite the photosensitive drums 1 of each color, and an opposing roller 59 situated opposite the secondary transfer roller 69, with a transfer belt 9 being stretched between the rollers. And, the transfer belt 9 is positioned opposite all the photosensitive drums 1, and circulates while in contact therewith. Voltage is applied to the primary transfer rollers 58 (58*a*, 58*b*, 58*c*, and 58*d*), thereby performing primary transfer from the photosensitive drums 1 to the transfer belt 9. Then, voltage is applied to the opposing roller 59 and the secondary transfer roller 69 arranged within the transfer belt 9, whereby the toner on the transfer belt 9 is transferred to the recording medium 9.

In performing image formation, the photosensitive drums 1 are rotated, and selected exposure is carried out by the scanner unit 3 on the photosensitive drums 1 uniformly charged by the charging rollers 2. As a result, electrostatic latent images are formed on the photosensitive drums 1. The latent images are developed by the developing rollers 25. As a result, toner images in each color are respectively formed on the photosensitive drums 1. In synchronism with this image formation, the registration roller pair 55 conveys the recording medium S to the secondary transfer position where the opposing roller 59 and the secondary roller 69 are held in contact with each other across the transfer belt 9. And, a transfer bias voltage is applied to the secondary transfer roller 69, whereby the toner images of each color on the transfer belt are secondarily transferred to the recording medium S. As a result, a color image is formed on the recording medium S. The recording medium S on which the color image has been formed is heated and pressed by the fixing unit 74, whereby the toner image is fixed to the recording medium. After this, the recording medium S is discharged to a discharge portion 75 by a discharge roller 72. The fixing unit 74 is arranged on top of the apparatus main body 100.

(Process Cartridge)

Figure 3:
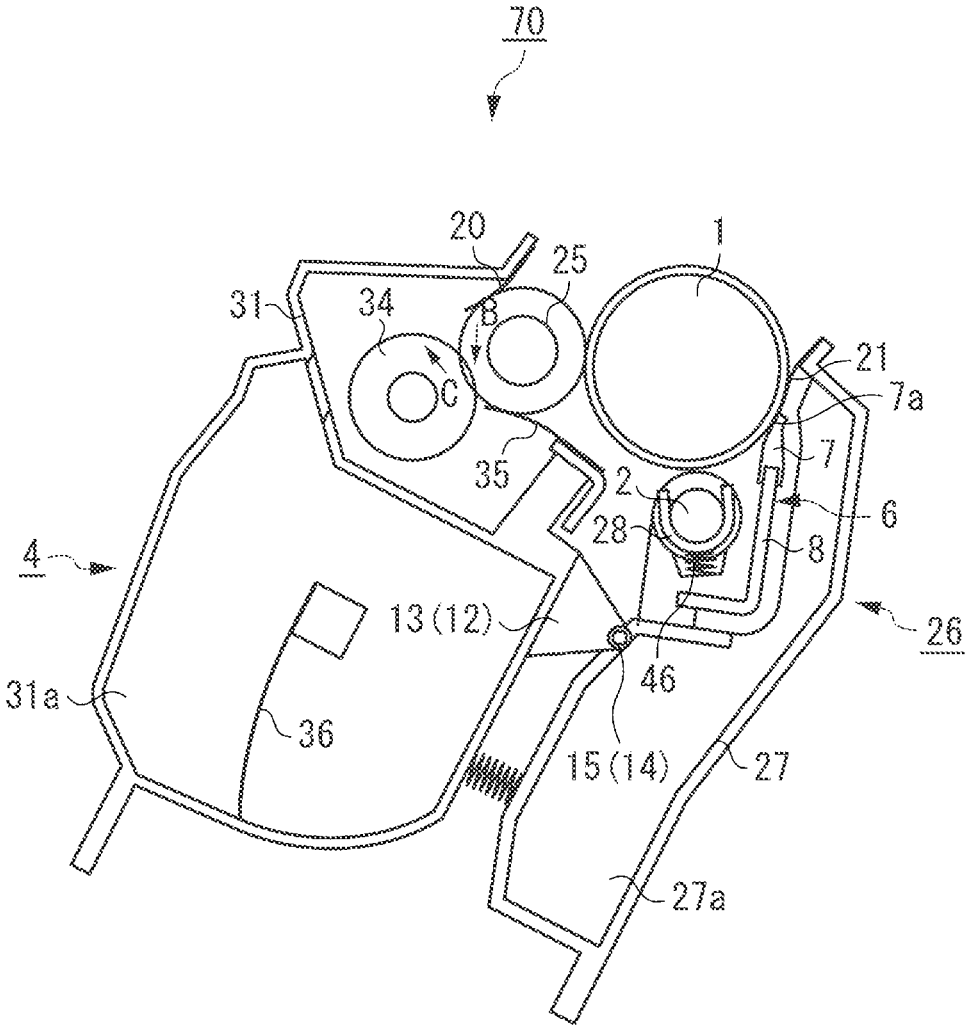
FIG. 3 is a main portion sectional view of a process cartridge according to an exemplary embodiment of the present invention.

Next, the process cartridge 70 to which the present invention is applied will be described with reference to FIGS. 3 and 4. FIG. 3 is a main portion sectional view of the process cartridge 70 which stores toner. The cartridge 70Y storing yellow toner, the cartridge 70M storing magenta toner, the cartridge 70C storing cyan toner, and the cartridge 70K storing black toner, are of the same construction.

The process cartridge 70 (70Y, 70M, 70C, and 70K) has a cleaning unit 26 (26*a*, 26*b*, 26*c*, and 26*d*), and a developing unit 4 (4*a*, 4*b*, 4*c*, 4*d*). The cleaning unit 26 is equipped with the photosensitive drum 1 (1*a*, 1*b*, 1*c*, 1*d*), the charging roller 2 (2*a*, 2*b*, 2*c*, 2*d*), and the cleaning member 6 (6*a*, 6*b*, 6*c*, 6*d*). And, the developing unit 4 is equipped with the developing roller 25.

As described above, in the periphery of the photosensitive drum 1, there are arranged the charging roller 2 and the cleaning member 6. The cleaning member 6 is composed of an elastic member 7 formed by a rubber blade, and a cleaning support member 8. A distal end portion 7*a* of the rubber blade 7 is arranged in contact with the photosensitive drum 1 while running counter to the rotational direction of the photosensitive drum 1. And, the residual toner removed from the surface of the photosensitive drum 1 by the cleaning member 6 falls into a removal toner chamber 27*a*. Further, a scooping sheet 21 preventing leakage of the removal toner in the removable toner chamber 27*a* is held in contact with the photosensitive drum 1. And, the drive force of a main body drive motor (not illustrated) serving as the drive source is transmitted to a cleaning unit 26, whereby the photosensitive drum 1 is rotated in accordance with the image forming operation. The charging roller 2 is rotatably mounted to the cleaning unit 26 via a charging roller bearing 28, and is pressed against the photosensitive drum 1 by a charging roller pressing member 46 to be driven and rotated by the photosensitive drum 1.

The developing unit 4 is composed of the developing roller 25 configured to rotate in the direction of the arrow B while in contact with the photosensitive drum 1, and a developing frame member 31 supporting the developing roller 25. The developing roller 25 is rotatably supported by the developing frame member 31 with a development front bearing 12 and a development depth bearing 13 respectively mounted to both sides of the developing frame member 31 via a front support pin 14 and a depth support pin 15 (see FIG. 3). Further, arranged on the peripheral surface of the developing roller 25 are a toner supply roller 34 configured to rotate in the direction of the arrow C in contact with the developing roller 25, and a developing blade 35 for regulating the toner layer on the developing roller 25. Further, there is arranged a bleeding prevention sheet 20 as a development contact sheet for preventing leakage of toner from the developing frame member 31 held in contact with the developing roller 25. Further, provided inside a toner storage chamber 31*a* of the developing frame member 31 is a toner conveyance member 36 configured to agitate the stored toner and to convey the toner to the toner supply roller 34.

Figure 4:
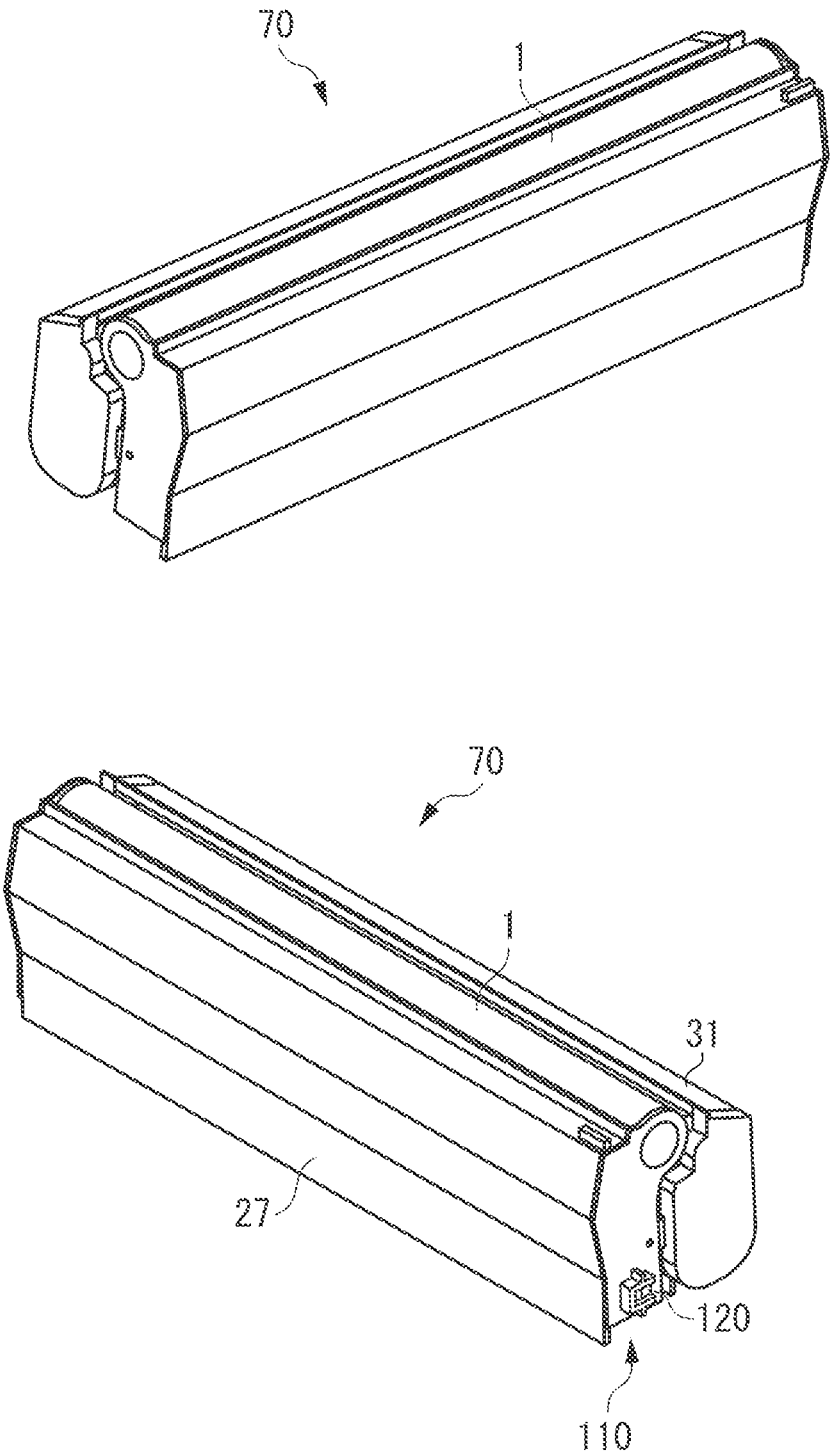
FIG. 4 is an overall perspective view of a process cartridge according to an exemplary embodiment of the present invention.

FIG. 4 is an overall perspective view of the process cartridge 70. A cartridge contact support 110 is provided on the frame member of the process cartridge 70, and a memory 120 is supported at the cartridge contact support 110. Assuming that the axial direction of the photosensitive drum 1 is the longitudinal direction, the cartridge contact support is provided at an end portion in the longitudinal direction and on the side of the frame member constituting the cleaning unit.

(Memory)

Figure 6A:
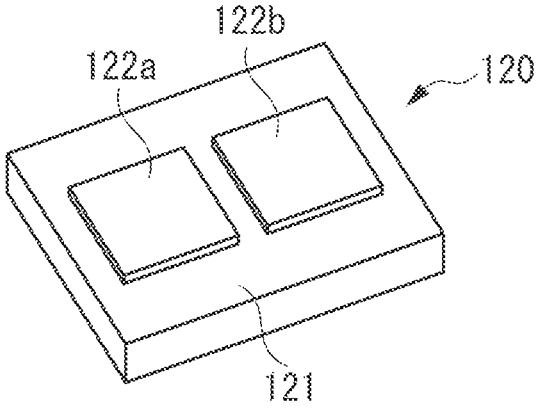
FIGS. 6A and 6B are explanatory views illustrating the construction of a memory according to an exemplary embodiment of the present invention.
Figure 6B:
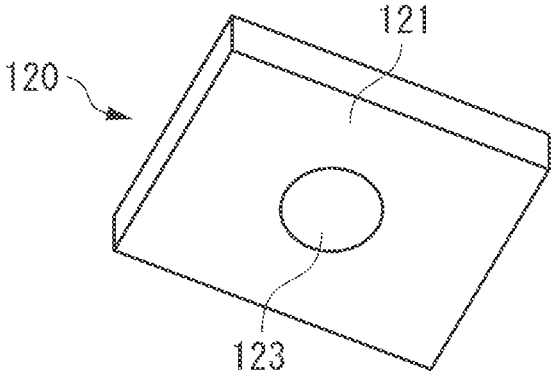

The process cartridge 70 to which the present invention is applied is equipped with the memory 120 as shown in FIG. 6, which has a memory portion 123 configured to store information such as the lot number of the process cartridge 70, the characteristics of the image forming apparatus, and the characteristics of the process unit.

The memory portion 123 may be embedded in a memory substrate 121. In the present exemplary embodiment, the memory portion 123 is provided in the surface of the memory substrate on the opposite side of the surface on which cartridge electrical contacts (122*a* and 122*b*) are provided.

The process cartridge 70 to which the present invention is applied exchanges information stored in the memory portion 123 between itself and the apparatus main body 100, whereby the use condition of the process cartridge 70 or the like is reported to a control unit (not illustrated) provided in the apparatus main body 100. And, by controlling the image formation according to the information, the image formation is performed in the optimum condition.

It is not always necessary for the memory portion to be of a circular configuration as illustrated in the drawing. It may be of an arbitrary configuration. While in the present exemplary embodiment the information on a process cartridge is stored in the memory portion, the present invention is also applicable to other types of cartridge. In a case of other types of cartridge, information peculiar to the cartridge is stored.

(Construction in Which the Process Cartridge Is Inserted into the Image Forming Apparatus)

Figure 5:
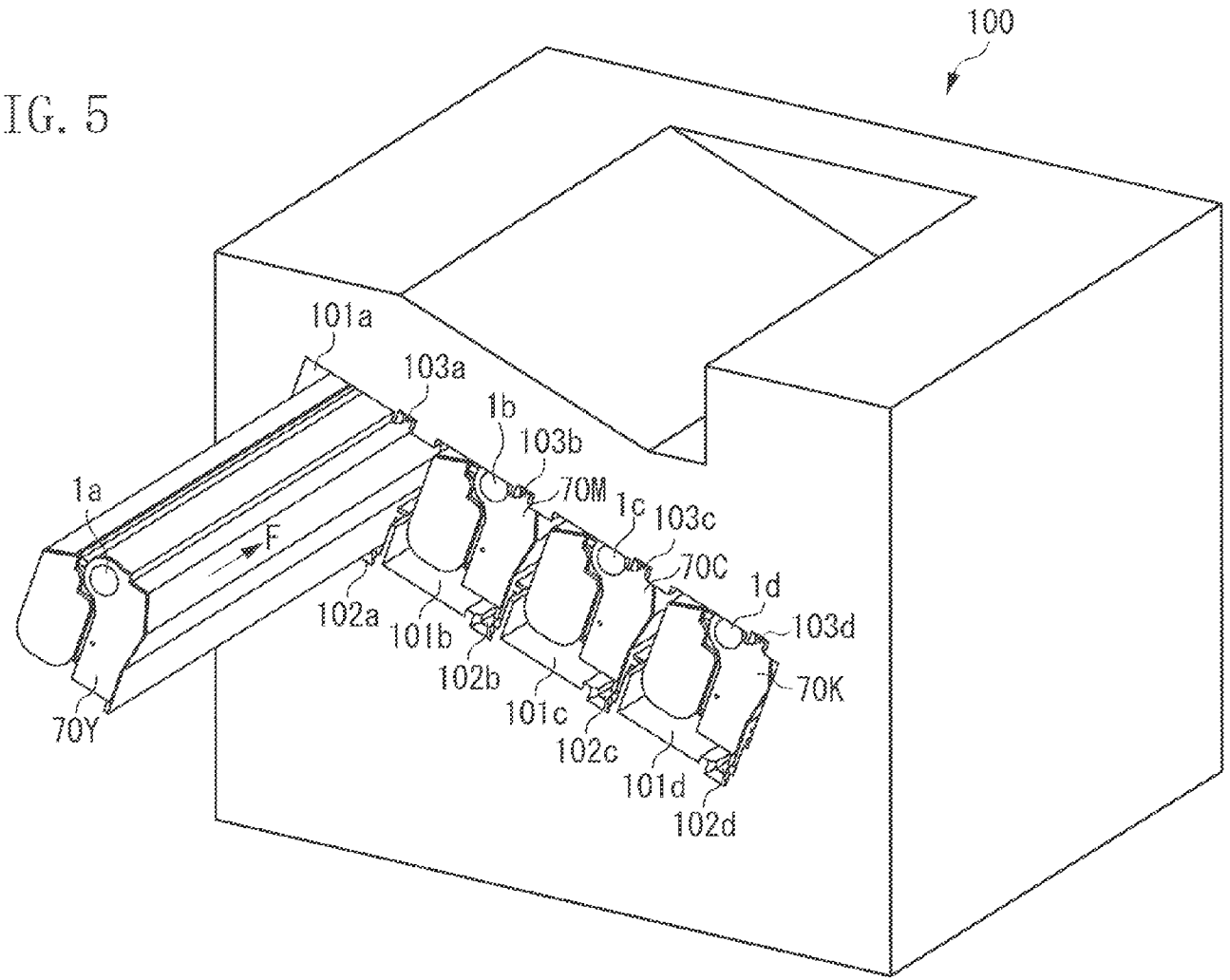
FIG. 5 is a schematic view illustrating how a process cartridge is attached to an image forming apparatus according to an exemplary embodiment of the present invention.

Next, the construction in which the process cartridge 70 is inserted into the image forming apparatus 100 will be described with reference to FIG. 5. In the present exemplary embodiment, in inserting the process cartridge 70 (70Y, 70M, 70C, 70K) into an image forming apparatus opening 101 (101*a*, 101*b*, 101*c*, 101*d*), the process cartridge 70 is inserted from the front side toward the depth side in a direction parallel to the axial direction of the photosensitive drum 1 (1*a*, 1*b*, 1*c*, 1*d*) (the direction of the arrow F in the drawing). In the present exemplary embodiment, the upstream side in the direction in which the process cartridge 70 is inserted will be defined as the front side, and the downstream side will be defined as the depth side. On the upper side of the interior of the image forming apparatus 100, there is provided an upper guide portion 103 (103*a*, 103*b*, 103*c*, 103*d*) for main body attachment which is a first main body guide portion, and, on the lower side thereof, there is provided a lower guide portion 102 (102*a*, 102*b*, 102*c*, 102*d*) for main body attachment, which is a second main body guide portion. The upper guide portion 103 for main body attachment and the lower guide portion 102 for main body attachment are configured as a guide extending in the direction F in which the process cartridge 70 is inserted. The process cartridge 70 is placed on the front side in the attachment direction of this lower guide portion 102 for main body attachment, and the process cartridge 70 is moved along the upper guide portion 103 for main body attachment and the lower guide portion 102 for main body attachment to insert the process cartridge into the image forming apparatus 100.

[Description of the Essential Elements of the Invention]

(Memory Support Construction)

Next, the support construction for the memory 120 of the process cartridge 70 according to the present invention will be described in detail.

As illustrated in FIGS. 1A through 1D, the process cartridge 70 is provided with the cartridge contact support 110 for supporting the memory 120. And, the direction in which the memory 120 is inserted into the cartridge contact support 110 will be referred to as the inserting direction Y, and the direction which is orthogonal to the inserting direction Y and which is the thickness direction of the memory 120 will be referred to as the height direction Z. And, the direction which is orthogonal to the inserting direction Y and the height direction Z will be referred to as the horizontal direction X. The cartridge contact support 110 is provided with an opening 116 for inserting the memory 120, and an inserting direction abutment portion 115 on which the memory abuts when the memory 120 is moved in the inserting direction Y. And, there are provided horizontal direction regulation portions 114*a* and 114*b* for regulating the movement in the horizontal direction X of the memory 120. Further, there are provided height direction regulation portions 113*a*, 113*b*, 113*c*, and 113*d* for regulating the movement of the memory 120 in the height direction Z. The height direction regulation portions 113 form an opening on the cartridge electrical contact (122*a* and 122*b*) side so that the cartridge electrical contacts (122*a* and 122*b*) may be exposed. Further, there is provided a flexible temporary fastening portion (which corresponds to the first movement regulation portion in the exemplary embodiment of FIGS. 1A through 1D) 112 configured to regulate the movement in the inserting direction Y of the memory 120 attached to the contact support position of the cartridge contact support 110 and to temporarily prevent detachment of the memory 120 from the opening 116. Further, there are provided protrusions (corresponding to the second movement regulation portion in the exemplary embodiment of FIG. 1D) 111*a* and 111*b* as stopper portions configured to regulate the movement in the inserting direction Y of the memory 120 attached to the cartridge contact support 110 through fusion bonding and to finally prevent detachment of the memory from the opening 116. Here, the expression "finally prevent" means that it is the protrusions that perform positional regulation in the inserting direction Y, and not the flexible temporary fastening portion. However, it is also possible for the flexible temporary fastening portion to continue to perform positional regulation in an auxiliary manner. The protrusions 111*a* and 111*b* are formed by fusion-bonding the pre-fusion-bonding protrusions 140*a* and 140*b*. And, the movement regulation distance that the protrusions 111*a* and 111*b* can regulate the movement of the memory, is shorter than the movement regulation distance that the flexible temporary fastening portion 112 regulates the movement of the memory.

(Memory Attachment Method)

Figure 7A:
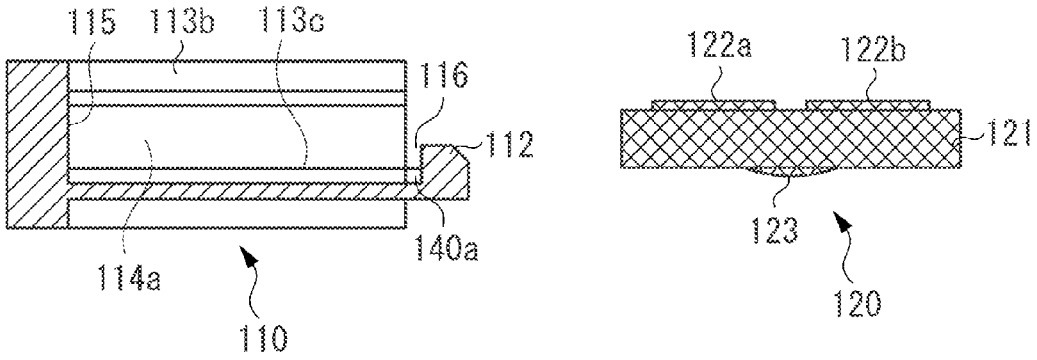
FIGS. 7A through 7E are explanatory views illustrating the operation of inserting a memory into a cartridge contact support according to an exemplary embodiment of the present invention.
Figure 7B:
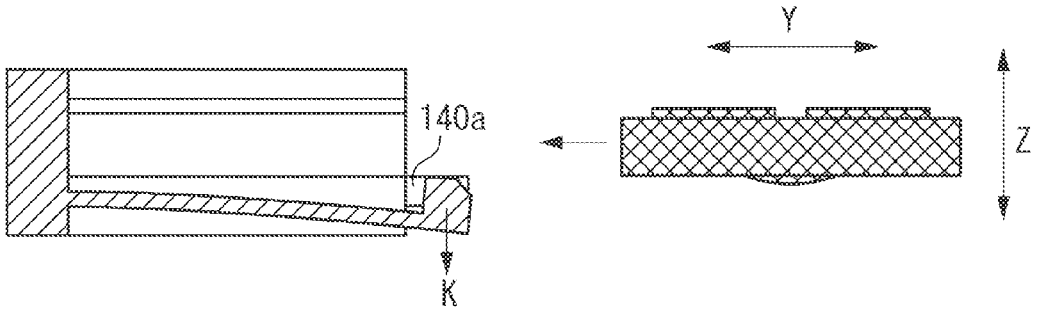
Figure 7C:
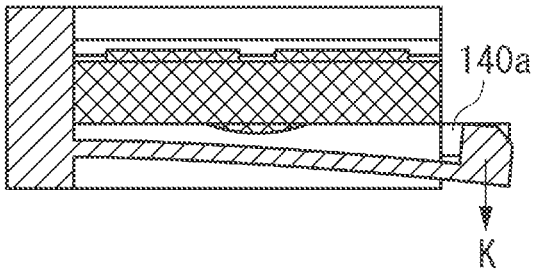
Figure 7D:
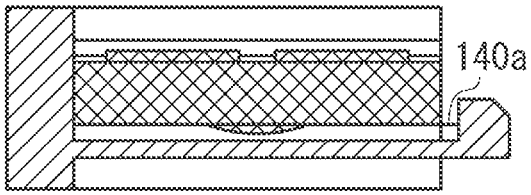
Figure 7E:
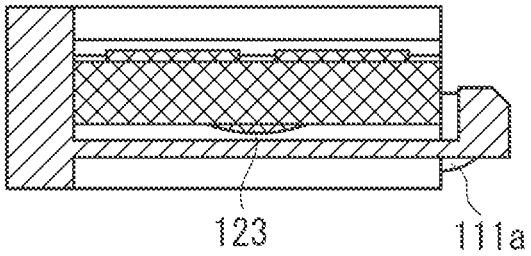

Next, a method of attaching the memory 120 to the cartridge contact support 110 will be described with reference to FIGS. 7A through 7E. FIG. 7A illustrates the initial state prior to the attachment of the memory 120. If, in this state, the memory 120 is moved in the inserting direction Y, it interferes with the flexible fastening portion 112, and the memory cannot be inserted into the contact support 110. Thus, as illustrated in FIG. 7B, a force K (illustrated in the drawing) in the height direction Z is first applied to the temporary fastening portion 112, whereby, at the time of insertion of the memory 120, the flexible temporary fastening portion 112 is displaced to a position where the flexible temporary fastening portion 112 and the memory 120 do not interfere with each other. Subsequently, as illustrated in FIG. 7C, the memory 120 is attached to the cartridge contact support 110. Next, as illustrated in FIG. 7D, the force K in the height direction Z which has been applied to the flexible temporary fastening member 112 is released, whereby the flexible temporary fastening portion is restored to the initial state. Finally, as illustrated in FIG. 7E, the pre-fusion-bonding protrusions 140*a* and 140*b* are fusion-bonded to form the protrusions 111*a* and 111*b*, whereby a part of the opening 116 is covered.

In this way, in the state illustrated in FIG. 7D, it is possible to temporarily prevent detachment of the memory 120 from the cartridge contact support 110. Thus, it is possible to execute another assembly process between the state of FIG. 7D and the state of FIG. 7E, thus improving degree of freedom regarding the assembling order.

Figure 8A:
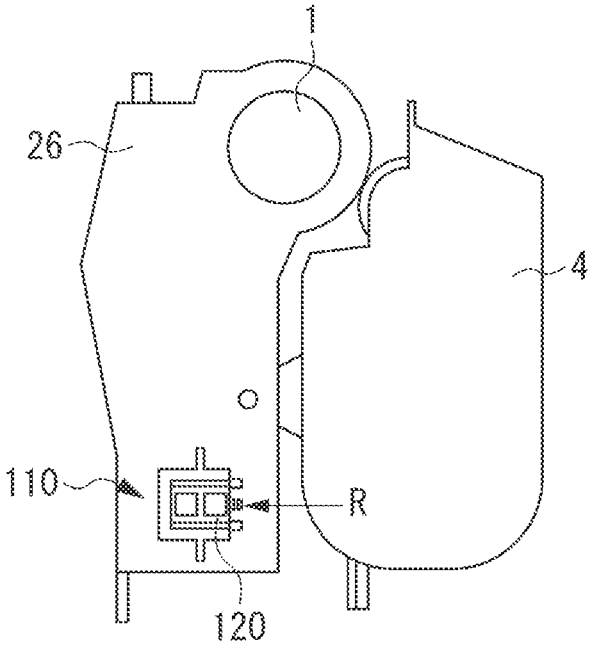
FIGS. 8A and 8B are explanatory views illustrating the arrangement of a cartridge contact support and a developing unit according to an exemplary embodiment of the present invention.
Figure 8B:
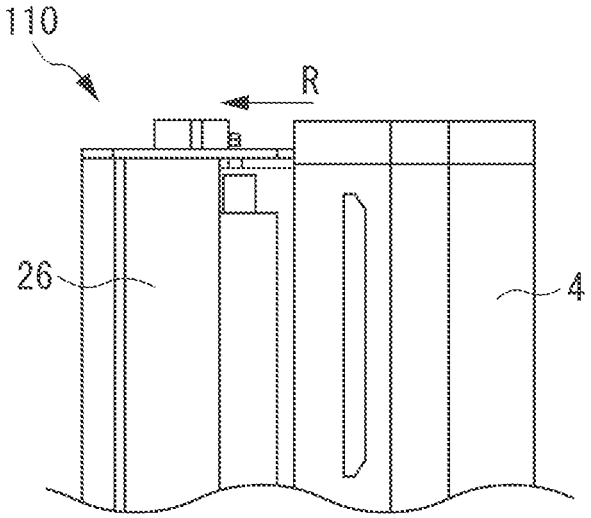

Suppose, as illustrated, for example, in FIG. 8A, in a process cartridge 70, the developing unit 4 is arranged in an extension of the inserting direction R of the memory 120 (which is parallel to the inserting direction Y), the cleaning unit 26 and the developing unit 4 are connected with each other, and the cartridge contact support 110 and the developing unit 4 are provided in parallel (i.e., overlap) in the axial direction of the photosensitive drum 1. That is, as illustrated in FIG. 8B, there is a case in which the developing unit 4 protrudes so as to prevent insertion of the memory. In this case, the range in which the developing unit allows insertion of the memory into the cartridge contact support 110 is diminished, so that it is very difficult to mount and extract the memory 120.

However, in the process cartridge 70 provided with the flexible temporary fastening portion 112 as described above, it is possible to mount the memory 120 before the connection of the cleaning unit 26 and the developing unit 4, and an improvement of degree of freedom in memory arrangement and assembly property can also be expected.

And, regarding the process cartridge 70 which has not been able to pass the inspection in the inspection process after the mounting of the memory 120, the steps of FIGS. 7A through 7D described above are performed in the reverse order, whereby it is possible to detach the memory 120 from the cartridge contact support 110, making it possible to re-utilize the cleaning frame member 27, etc. from which the memory 120 has been removed. Regarding the process cartridge 70 having passed the inspection at the final inspection (i.e., one found to be OK), the mounting process (fusion bonding process) of FIG. 7E described above is executed thereon, whereby the process cartridge 70 is completed.

(Details of the Memory Support Construction)

Next, the memory support construction in the process cartridge 70 will be described in detail.

An additional construction of the cartridge contact support 110 in the process cartridge 70 according to the present exemplary embodiment, and the construction of the main body contact support 130 in the image forming apparatus 100 will be described with reference to FIGS. 1 and 8 through 13.

FIGS. 8A and 8B illustrate the installation position of the cartridge electrical contact support 110. The cartridge contact support 110 is provided on a side of the cleaning frame member (which corresponds, in the present exemplary embodiment, to the first frame member) 27 of the cleaning unit, and, in FIGS. 8A and 8B, the cartridge contact support is not provided on the frame member of the developing unit (which corresponds, in the present exemplary embodiment, to the second frame member). However, it may be provided on the developing unit side if what is to be controlled is the developer condition, etc. or the developing unit. Further, to prevent the memory surface from being soiled by toner or the like adhering to the photosensitive member, the cartridge contact support is provided at an end portion in the longitudinal direction of the cartridge. More specifically, it is provided at the end portion on the opposite side of the end portion where the photosensitive member is provided.

Figure 9A:
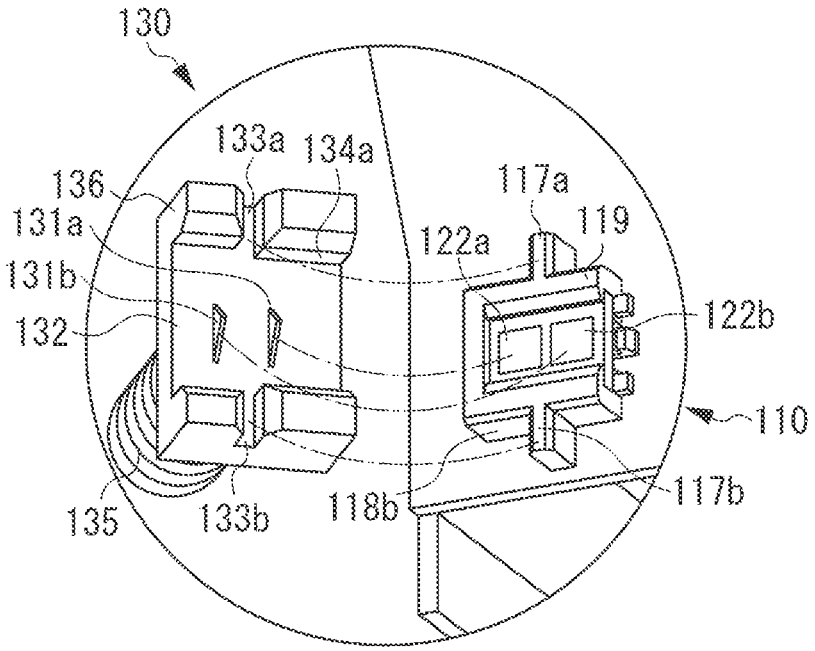
FIGS. 9A and 9B are structural explanatory views illustrating how a cartridge contact support and a main body contact support are engaged with each other according to an exemplary embodiment of the present invention.
Figure 9B:
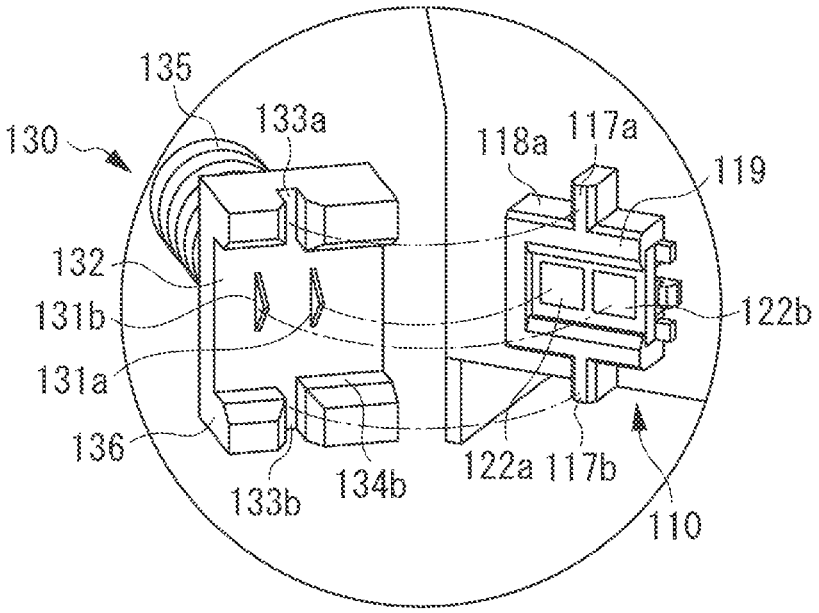
Figure 10A:
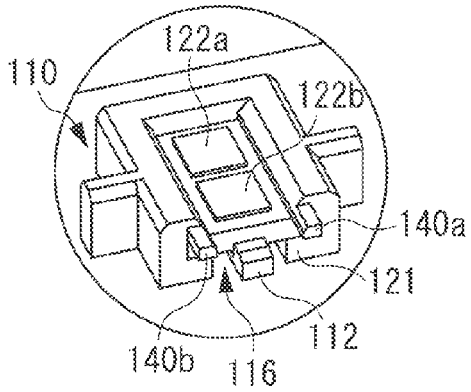
FIGS. 10A through 10D are explanatory views illustrating the construction of a cartridge contact support according to an exemplary embodiment of the present invention.
Figure 10B:
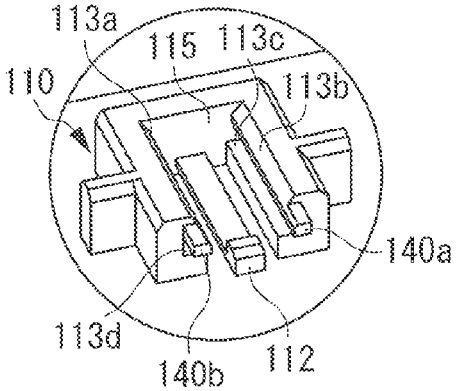
Figure 10C:
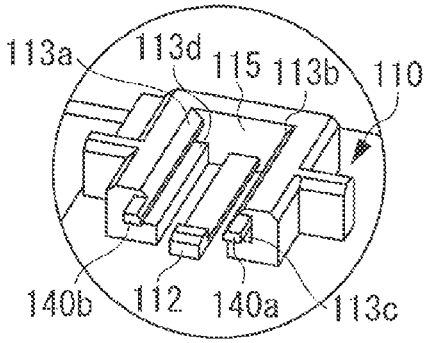
Figure 10D:
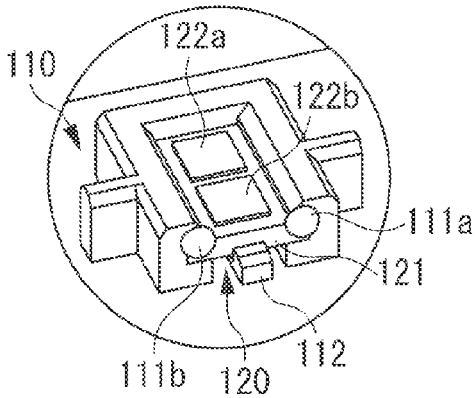

FIGS. 9A and 9B show that it is possible to connect the cartridge contact support 110 of the process cartridge 70 and the main portion contact support of the image forming apparatus 100 with each other. The cartridge contact support 110 is provided with cartridge inserting direction positioning portions 117*a* and 117*b* configured to be engaged with main body inserting direction positioning portions 133*a* and 133*b* of the main body contact support 130 and to determine the position in the inserting direction Y. Similarly, there are provided cartridge horizontal direction positioning portions 118*a* and

118*b* configured to be engaged with main body horizontal direction positioning portions 134*a* and 134*b* of the main body electrical contact 130 and to determine the position in the horizontal direction X. Further, a main body contact retaining portion 136 of the main body contact support is pressed against the cartridge contact support 110 by an urging spring 135, and a main body abutment portion 132 abuts on the height direction abutment portion 119 to determine a position. And, resilient main body electrical contact portions 131*a* and 131*b* are brought into contact with the cartridge electrical contacts 122*a* and 122*b* to establish a conductive state.

Figure 11A:
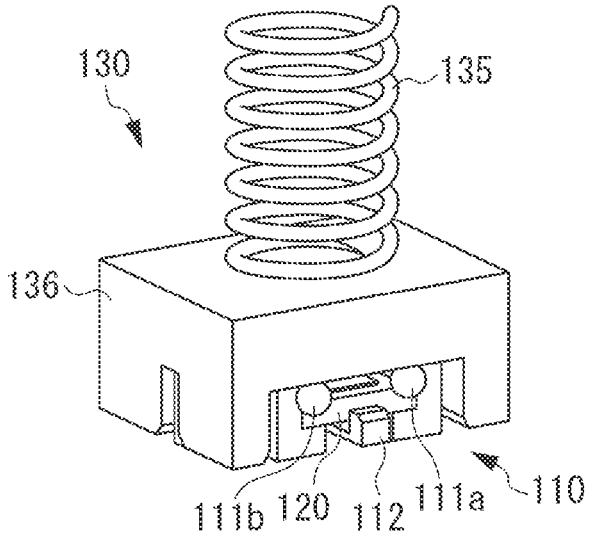
FIGS. 11A and 11B are explanatory views illustrating how a cartridge contact support and a main body contact support are engaged with each other according to an exemplary embodiment of the present invention.
Figure 11B:
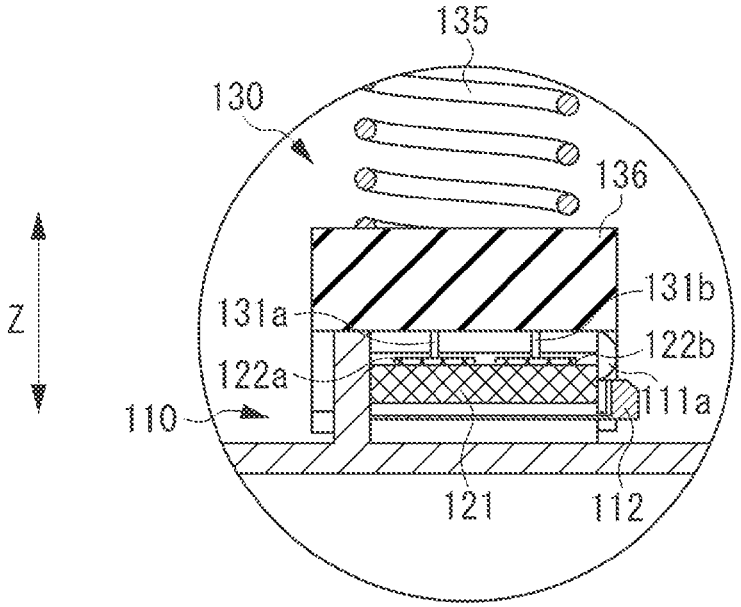

Next, the protrusions 111*a* and 111*b* provided on the cartridge contact support 110 will be described. As illustrated in FIGS. 10A through 10D, the protrusions 111*a* and 111*b* have conventionally been provided on the cartridge electrical contact 122 side with respect to the memory substrate 121 in the height direction Z. Also in this construction, the effect of the present invention can be attained. As illustrated in FIGS. 11A and 11B, however, in this construction, the distance between the protrusions 111 and the main body contact retaining portion 136 after fusion-bonding is short (i.e., the clearance is small), and it is necessary to perform the step of controlling the position of the protrusions 111 in the height direction Z.

Figure 12A:
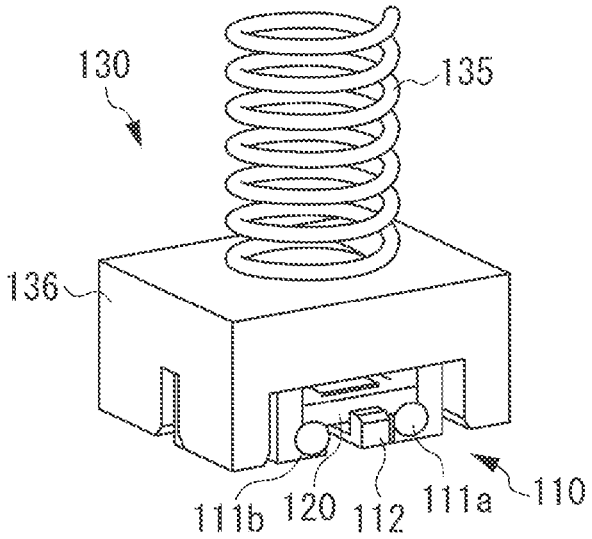
FIGS. 12A and 12B are explanatory views illustrating the construction of a cartridge contact support according to an exemplary embodiment of the present invention.
Figure 12B:
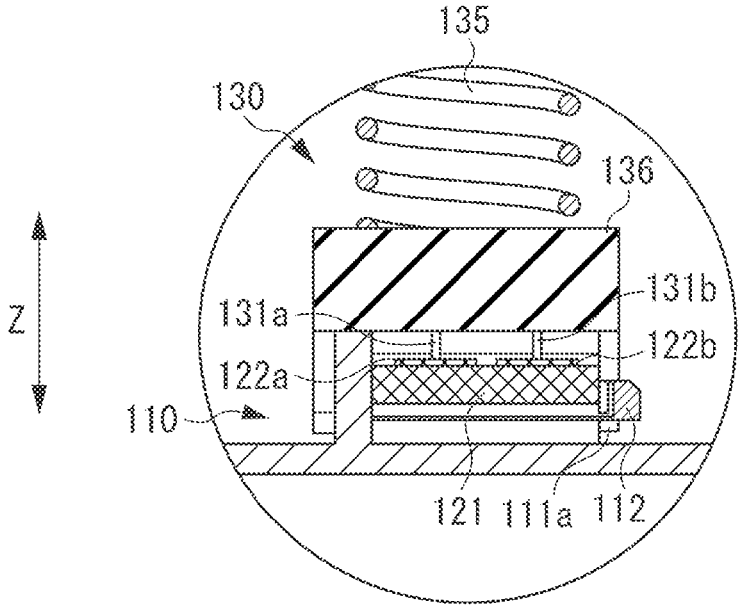

On the other hand, as illustrated in FIGS. 1A through 1D, by providing the protrusions 111 on the side opposite to the cartridge electrical contact side in the height direction Z with respect to the memory substrate, it is possible to secure a sufficient distance (i.e., secure a sufficient clearance) between the protrusions 111 and the main body contact retaining portion 135 as illustrated in FIG. 12. As a result, it is possible to eliminate the step of controlling the position of the protrusions 111 in the height direction Z after fusion-bonding, which is more desirable.

Figure 13:
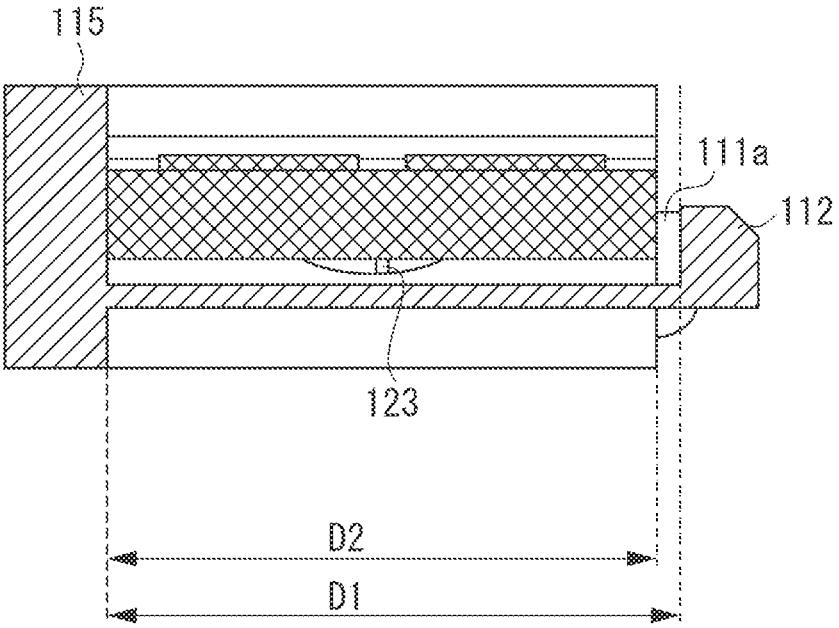
FIG. 13 is a schematic explanatory view illustrating how a cartridge contact support and a main portion support are engaged with each other according to an exemplary embodiment of the present invention.

The relationship between the first movement regulation portion and the second movement regulation portion will be described with reference to FIG. 13 by using the flexible temporary fastening portion and the protrusions. In the exemplary embodiment illustrated in FIG. 13, the flexible temporary fastening portion 112 is the first movement regulation portion, and the protrusions 111 are the second movement regulation portion. In this case, the movement regulation direction in which the movement of the memory is regulated by the flexible temporary fastening portion is the same as the movement direction in which the movement of the memory is regulated by the protrusions, i.e., they are the same as the inserting direction Y. Further, the distance D2 (second movement regulation distance) that the movement of the memory is regulated by the protrusions must be shorter than or equal to the distance D1 (first movement regulation distance) that the movement of the memory is regulated by the flexible temporary fastening portion (D2≤D1). This is due to the fact that the flexible temporary fastening portion serves to temporarily retain the memory, whereas the protrusions must further regulate the memory position taking into consideration the necessity of connecting the memory to some other apparatus.

Figure 14A:
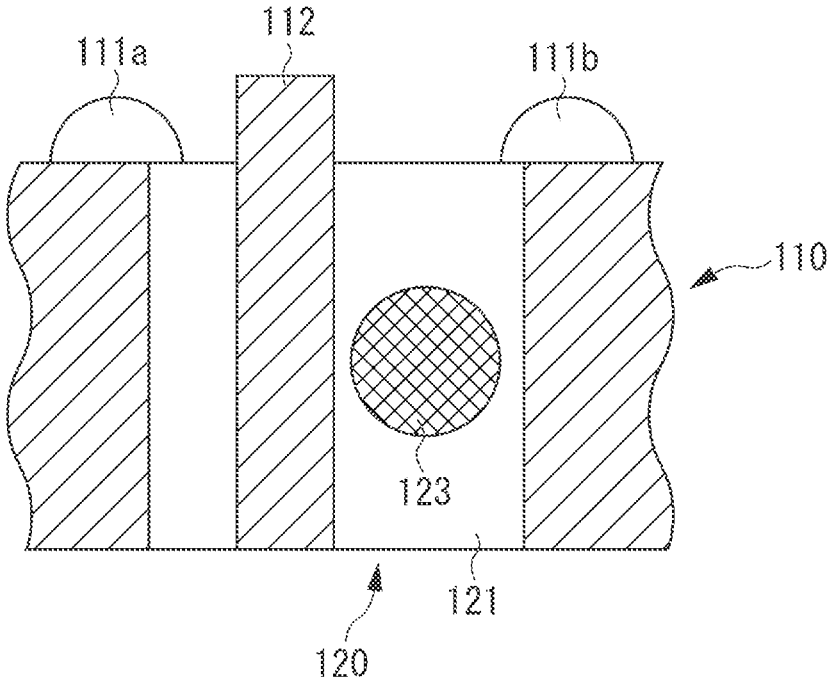
FIGS. 14A and 14B are diagrams illustrating the positional relationship between a memory portion and a flexible temporary fastening portion according to an exemplary embodiment of the present invention.
Figure 14B:
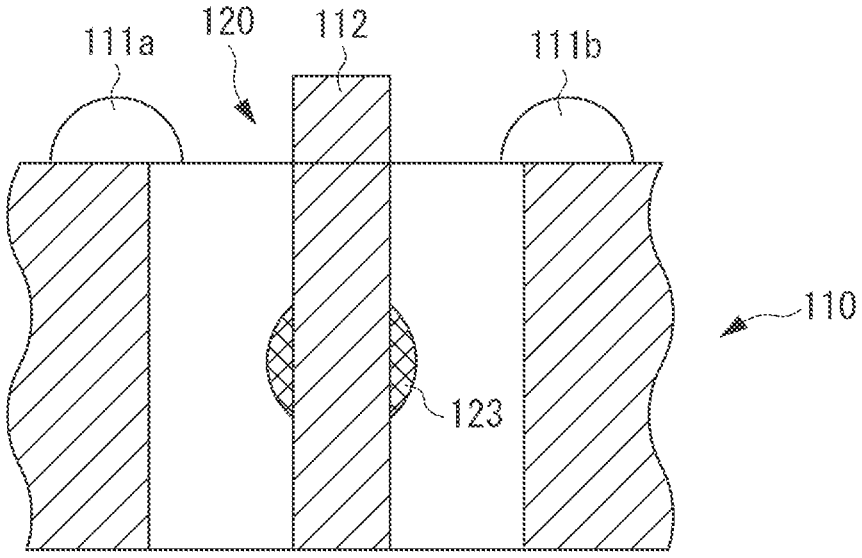

The flexible temporary fastening portion has a claw portion and a beam extending in the movement regulating direction (inserting direction). Flexibility is provided by the shape of the beam. Thus, the flexible temporary fastening portion and the cartridge electrical contact support can be integrally formed of the same material. In order that the flexible temporary fastening portion may be capable of moving up and down in the height direction, it is desirable to provide gaps on the upper and lower sides of the flexible temporary fastening portion. As illustrated in the sectional view of FIG. 7E, as an example, the cartridge electrical contact, the memory substrate, the memory portion, and the flexible temporary fastening portion are arranged in that order from the exterior toward the frame member. FIG. 14A illustrates another possible form of arrangement. FIGS. 14A and 14B illustrate, from the memory portion side, the positional relationship between the memory and the flexible temporary fastening portion in the case where the memory is supported at the support position. FIG. 14B illustrates the exemplary embodiment of FIG. 7E from the memory portion side. FIG. 14A illustrates a modification, in which the flexible temporary fastening portion and the memory portion are arranged at different positions. When, as in the case of FIG. 14B, the memory portion and the flexible temporary fastening portion are arranged so as to overlap each other, it is necessary to take into consideration the thickness of the memory portion, the thickness of the flexible temporary fastening portion, and the space between the flexible temporary fastening portion and the memory portion. On the other hand, in the case where they are arranged at different positions as illustrated in FIG. 14, when seen in section, it looks like that the cartridge electrical contact, the memory substrate, the memory portion, and the flexible temporary fastening portion are arranged in that order, and it is possible to provide the flexible temporary portion and the memory portion at positions where they overlap each other. If the memory portion is arranged as illustrated in FIG. 14B, there is no need to take into consideration the thickness of the memory portion. In any case, it is desirable that the memory substrate, the flexible temporary fastening portion, the space, and the frame member are arranged in that order. The space is formed by the frame member, the flexible temporary fastening portion, and the height direction regulation members 113*b* and 113*d*.

(Other Application Examples)

While in the above-described exemplary embodiment, the movement of the memory is regulated by the protrusions 111, serving as the second movement regulation portion, this should not be construed restrictively. Instead of using the protrusions, it is also possible to regulate the movement of the memory by the cleaning frame member 27, the developing frame member 31, etc. In this case, the second movement regulation member is formed by the cleaning frame member 27 or the developing frame member 31. More specifically, the place where the cartridge contact support is provided is the side cover or other frame members, and, it is possible to regulate the movement of the memory by sealing or diminishing the opening in fusion-bonding of a part of the cleaning frame member or a part of the developing frame member in the insertion opening after the insertion of the memory. In this case, no protrusions are formed, which means it is possible to achieve a reduction in the number of components.

Further, while up till now portions different from the flexible temporary fastening portion have been fusion-bonded as the protrusions 111 to form the second movement regulation member at the time of the production of the cartridge, it is also possible to deform the flexible fastening portion itself into a protrusion through fusion-bonding to use it as the second movement regulation member. In this case, in the cartridge as the final product, the first movement regulation portion is replaced by the second movement regulation portion, which means there is no first movement regulation portion, which as advantage achieves a reduction in the number of components.

According to the present invention, it is possible to achieve an improvement in terms of degree of freedom in memory assembling order. Further, an improvement in terms of degree of freedom in memory arrangement and an improvement in terms of assembling property are also to be expected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-214482 filed Sep. 27, 2012, which is hereby incorporated by reference herein in its entirety.

What is claimed is:

1. A cartridge comprising:

a memory portion configured to store information regarding the cartridge;

a substrate having the memory portion and an electrical contact;

a support portion for supporting the substrate with the electrical contact being exposed;

a first movement regulation portion being flexible and configured to regulate the movement of the substrate; and a second movement regulation portion configured to regulate the movement of the substrate, wherein the movement regulation direction in which the movement of the substrate is regulated by the second movement regulation portion is the same as the movement regulation direction in which the movement of the substrate is regulated by the first movement regulation portion, and wherein the movement regulation distance that the movement of the substrate is regulated by the second movement regulation portion, is shorter than or equal to the movement regulation distance that the movement of the substrate is regulated by the first movement regulation portion.

2. The cartridge according to claim 1, wherein the first movement regulation portion is movable in the height direction of the substrate.

3. The cartridge according to claim 1, wherein the first movement regulation portion has a claw portion.

4. The cartridge according to claim 1, wherein the first movement regulation portion has a beam extending in the movement regulation direction.

5. The cartridge according to claim 1, wherein the support portion and the first movement regulation portion are formed of the same material.

6. The cartridge according to claim 1, wherein the second movement regulation portion is a frame member of the cartridge.

7. The cartridge according to claim 1, wherein the electrical contact is provided at an end portion in the longitudinal direction of the cartridge.

8. The cartridge according to claim 1, wherein the electrical contact is provided on a frame member having an electrophotographic photosensitive member.

9. An apparatus comprising:

a main body electrical contact configured to be electrically connected to the electrical contact of a cartridge as claimed in claim 1; and a control unit configured to read information stored in a memory portion via the main body electrical contact.

10. A process cartridge detachable from and attachable to an image forming apparatus having a main body electrical contact, comprising:

a memory configured to store information related to the process cartridge;

an electrical contact that can be electrically connected to the main body electrical contact; and a cartridge contact support configured to support the memory at a support position, wherein, assuming that the direction in which the memory is inserted to the support position is an inserting direction, that the thickness of direction of the memory is a height direction, and a direction orthogonal to the inserting direction and the height direction is a horizontal direction, the cartridge contact support has an opening for inserting the memory to the support position, a horizontal direction regulation portion configured to regulate the movement in the horizontal direction of the memory attached to the support position, and a height direction regulation portion configured to regulate the movement in the height direction of the memory attached to the support position, the process cartridge further comprising:

a flexible temporary fastening portion configured to pass the opening and to temporarily regulate the movement of the memory attached to the support position in the inserting direction; and a fastening portion finally regulating the movement of the memory in the inserting direction.

11. The process cartridge according to claim 10, further comprising:

a first frame member having the support portion; and a second frame member to be connected with the first frame member, wherein the second frame member is arranged in the inserting direction with respect to the first frame member.

12. The process cartridge according to claim 11, wherein the fastening portion configured to finally regulate the movement of the memory in the inserting direction is provided opposite the cartridge electrical contact side of a memory substrate in the height direction.

13. An image forming apparatus detachable from and attachable to a process cartridge and configured to form an image on a recording medium, comprising:

a process cartridge as claimed in claim 10;

a main body guide portion configured to guide the process cartridge to attach the process cartridge; and a main body electrical contact that can be electrically connected to the cartridge electrical contact of the process cartridge.

14. A method of manufacturing a cartridge comprising, forming a memory configured to store information regarding the cartridge, a substrate having the memory and an electrical contact, a support portion for supporting the substrate with the electrical contact being exposed, a first movement regulation portion being flexible and configured to regulate the movement of the substrate by means of the support portion, and a second movement regulation portion configured to regulate the movement of the substrate through fusion-bonding.

15. The method of manufacturing a cartridge according to claim 14, wherein a frame member has a protrusion, and wherein the protrusion is deformed into the second movement regulation portion through fusion-bonding.

16. The method of manufacturing a cartridge according to claim 15, wherein the first movement regulation portion is deformed into the second movement regulation portion through fusion-bonding.

17. A cartridge comprising:

a memory portion configured to store information regarding the cartridge;

a substrate having the memory portion and an electrical contact;

a support portion for supporting the substrate with the electrical contact being exposed;

a temporary fastening portion for temporarily regulating movement of the substrate; and a fastening portion for finally regulating the movement of the substrate, wherein a direction in which the movement of the substrate is regulated by the temporary fastening portion is the same as a direction in which the movement of the substrate is regulated by the fastening portion.

18. The cartridge according to claim 17, wherein the temporary fastening portion is flexible.

* * * * *